US011446804B2

(12) United States Patent
Liu et al.

(10) Patent No.: US 11,446,804 B2
(45) Date of Patent: Sep. 20, 2022

(54) PNEUMATIC PALLET NAILER

(71) Applicant: Basso Industry Corp., Taichung (TW)

(72) Inventors: An-Gi Liu, Taichung (TW); Fu-Yi Huang, Taichung (TW)

(73) Assignee: Basso Industry Corp., Taichung (TW)

( * ) Notice: Subject to any disclaimer, the term of this patent is extended or adjusted under 35 U.S.C. 154(b) by 109 days.

(21) Appl. No.: 17/151,646

(22) Filed: Jan. 18, 2021

(65) Prior Publication Data

US 2021/0220980 A1 Jul. 22, 2021

(30) Foreign Application Priority Data

Jan. 20, 2020 (TW) ..... 109200861

(51) Int. Cl.
*B25C 7/00* (2006.01)
*B25C 1/04* (2006.01)
*B27M 3/00* (2006.01)

(52) U.S. Cl.
CPC ..... *B25C 1/047* (2013.01); *B25C 7/00* (2013.01); *B27M 3/0073* (2013.01)

(58) Field of Classification Search
CPC ... B25C 7/00; B25C 1/047; B25C 5/13; B27F 7/09; B27F 7/34
See application file for complete search history.

(56) References Cited

U.S. PATENT DOCUMENTS 8,998,056 B2 * 4/2015 Huang ..... B25C 1/047 227/124
9,993,913 B2 * 6/2018 McCardle ..... B25C 7/00
10,611,009 B2 * 4/2020 Huang ..... B25C 7/00
2014/0076954 A1 3/2014 Miller et al.
2014/0209657 A1 * 7/2014 Huang ..... B27F 7/09 227/19
2017/0297188 A1 * 10/2017 Huang ..... B25C 7/00
2018/0354112 A1 * 12/2018 Huang ..... B25C 1/047

FOREIGN PATENT DOCUMENTS

TW M525253 U 7/2016
TW M545674 U 7/2017

* cited by examiner

*Primary Examiner* — Andrew M Tecco
(74) *Attorney, Agent, or Firm* — CKC & Partners Co., LLC

(57) ABSTRACT

A pneumatic pallet nailer includes a nailer body, a trigger member, a pallet clamp controlling member, a pallet clamp cylinder and a pallet clamp. The trigger member is disposed on the nailer body. The pallet clamp controlling member is disposed on the nailer body and includes an internal space, a first pipe, a second pipe, a third pipe and an actuating valve. The air in the nailer body is communicated with the internal space by the first pipe and the second pipe. The third pipe is communicated with the internal space. The actuating valve is movably disposed in the internal space, and the actuating valve is actuated and positioned at a first position or a second position. The pallet clamp cylinder is communicated to the third pipe. When the trigger member is pressed, the pallet clamp is actuated by the pallet clamp cylinder to clamp a workpiece.

6 Claims, 7 Drawing Sheets

PNEUMATIC PALLET NAILER

RELATED APPLICATIONS

This application claims priority to Taiwan Application Serial Number 109200861, filed Jan. 20, 2020, which is herein incorporated by reference.

BACKGROUND

Technical Field

The present disclosure relates to a nailer. More particularly, the present disclosure relates to a pneumatic pallet nailer.

Description of Related Art

A pneumatic nailer is a common hand tool, which is used to automatically trigger nails to connect and fasten two boards or a plurality of boards. The usage thereof is very convenient; therefore, the pneumatic nailer is also widely used in the pallet assembly.

When the pallets are assembled, the operator usually holds the nailer to fasten the horizontal wooden board and the vertical wooden board. In order to ensure a stable connection between the pallets, a positioning tool is required to temporarily fix the two pallets first, and then the nailer can be operated. However, the aforementioned processing for assembling the wooden boards is time-consuming and labor-intensive.

Based on the abovementioned problems, how to efficiently improve the structure of the pneumatic nailer for conveniently applying in pallet assembling becomes a pursuit target for practitioners.

SUMMARY

According to one embodiment of the present disclosure, a pneumatic pallet nailer includes a nailer body, a trigger member, a pallet clamp controlling member, a pallet clamp cylinder, and a pallet clamp. The trigger member is disposed on the nailer body. The pallet clamp controlling member is disposed on the nailer body and comprises an internal space, a first pipe, a second pipe, a third pipe, and an actuating valve. The first pipe is communicated with the internal space. An air in the nailer body enters the internal space through the trigger member and the first pipe. The second pipe is for communicating the air in the nailer body with the internal space. The third pipe is communicated with the internal space. The actuating valve is movably accommodated in the internal space, and the actuating valve is actuated and positioned at a first position or a second position. The pallet clamp cylinder is communicated with the third pipe. The pallet clamp is actuated by the pallet clamp cylinder. When the trigger member is not actuated, the air enters the internal space through the first pipe to generate a first direction force for pushing the actuating valve, and the air enters the internal space through the second pipe to generate a second direction force for pushing the actuating valve, the first direction force is greater than the second direction force, and the actuating valve is maintained at the first position to prevent the air from flowing into the third pipe from the second pipe. When the trigger member is pressed, the air in the first pipe is released through the trigger member, so that the second direction force is greater than the first direction force, and the actuating valve is pushed to be positioned at the second position, the air is allowed to flow into the third pipe and the pallet clamp cylinder through the second pipe, so that the pallet clamp is actuated to clamp a workpiece.

BRIEF DESCRIPTION OF THE DRAWINGS

The present disclosure can be more fully understood by reading the following detailed description of the embodiment, with reference made to the accompanying drawings as follows.

DETAILED DESCRIPTION

The embodiment will be described with the drawings. For clarity, some practical details will be described below. However, it should be noted that the present disclosure should not be limited by the practical details. That is, in some embodiment, the practical details are unnecessary. In addition, for simplifying the drawings, some conventional structures and elements will be simply illustrated, and repeated elements may be represented by the same labels.

In addition, it will be understood that when an element (or mechanism or module) is referred to as being "disposed on", "connected to" or "coupled to" another element, it can be directly disposed on, connected or coupled to the other one element, or it can be indirectly disposed on, connected or coupled to the other one element, that is, intervening elements may be present. In contrast, when an element is referred to as being "directly disposed on," "directly connected to" or "directly coupled to" another element, there are no intervening elements present. The terms first, second, third, etc. are used herein to describe various elements or components, these elements or components should not be limited by these terms. Consequently, a first element or component discussed below could be termed a second element or component.

Figure 1:
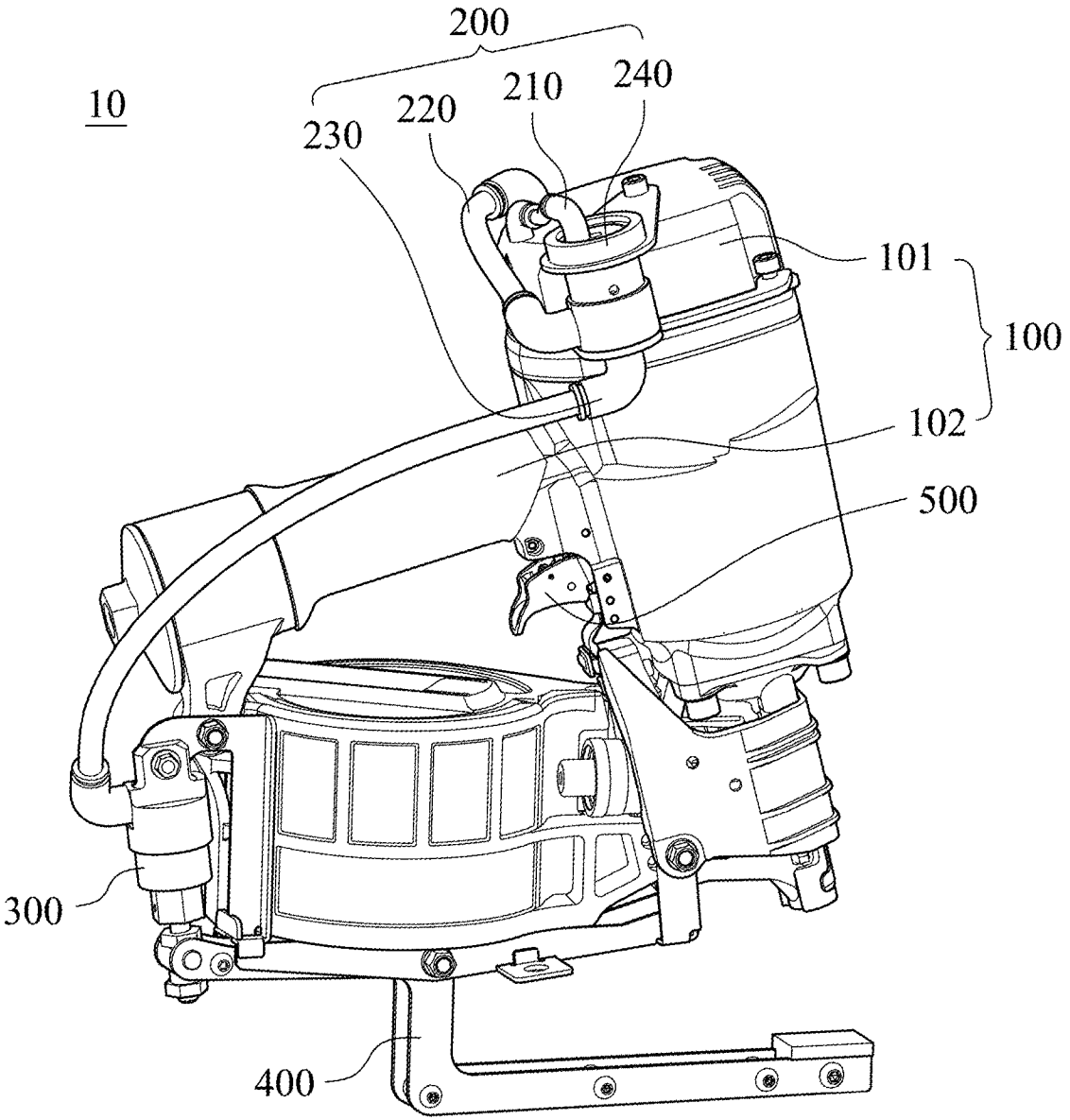
FIG. 1 shows a three dimensional schematic view of a pneumatic pallet nailer according to one embodiment of the present disclosure.
Figure 2:
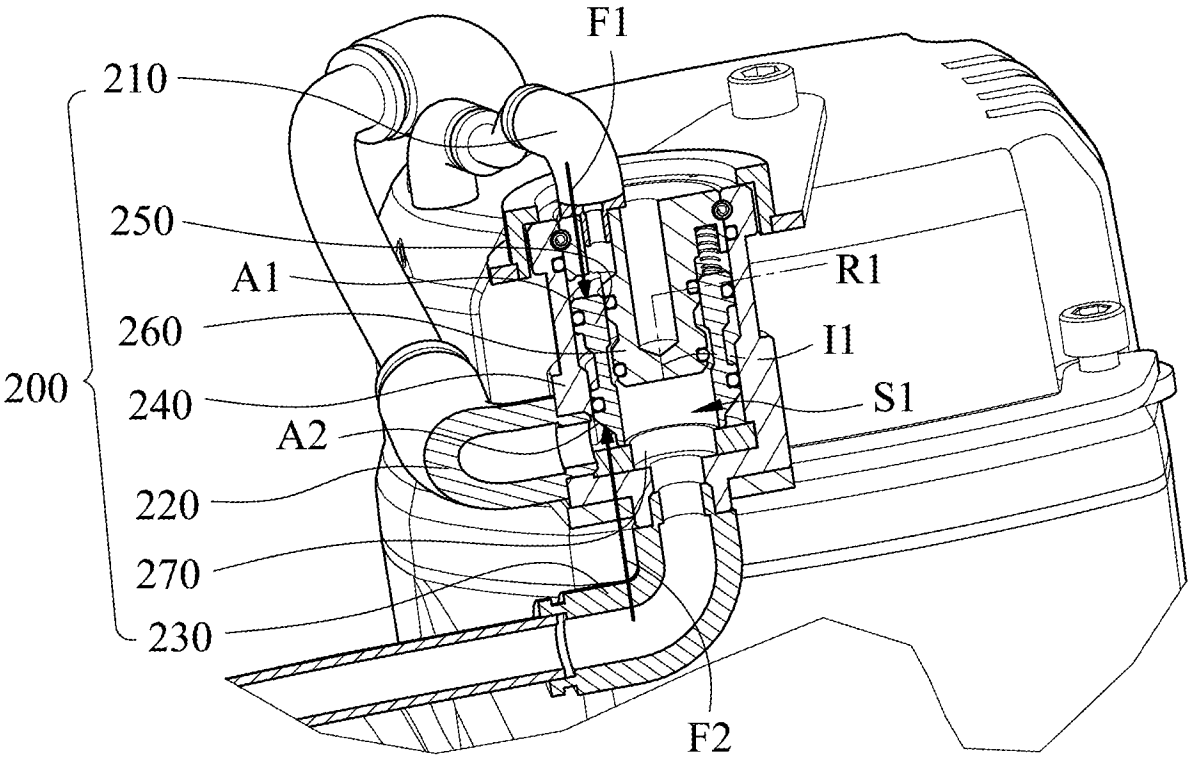
FIG. 2 shows one partial cross-sectional view of the pneumatic pallet nailer according to the embodiment of FIG. 1.
Figure 3:
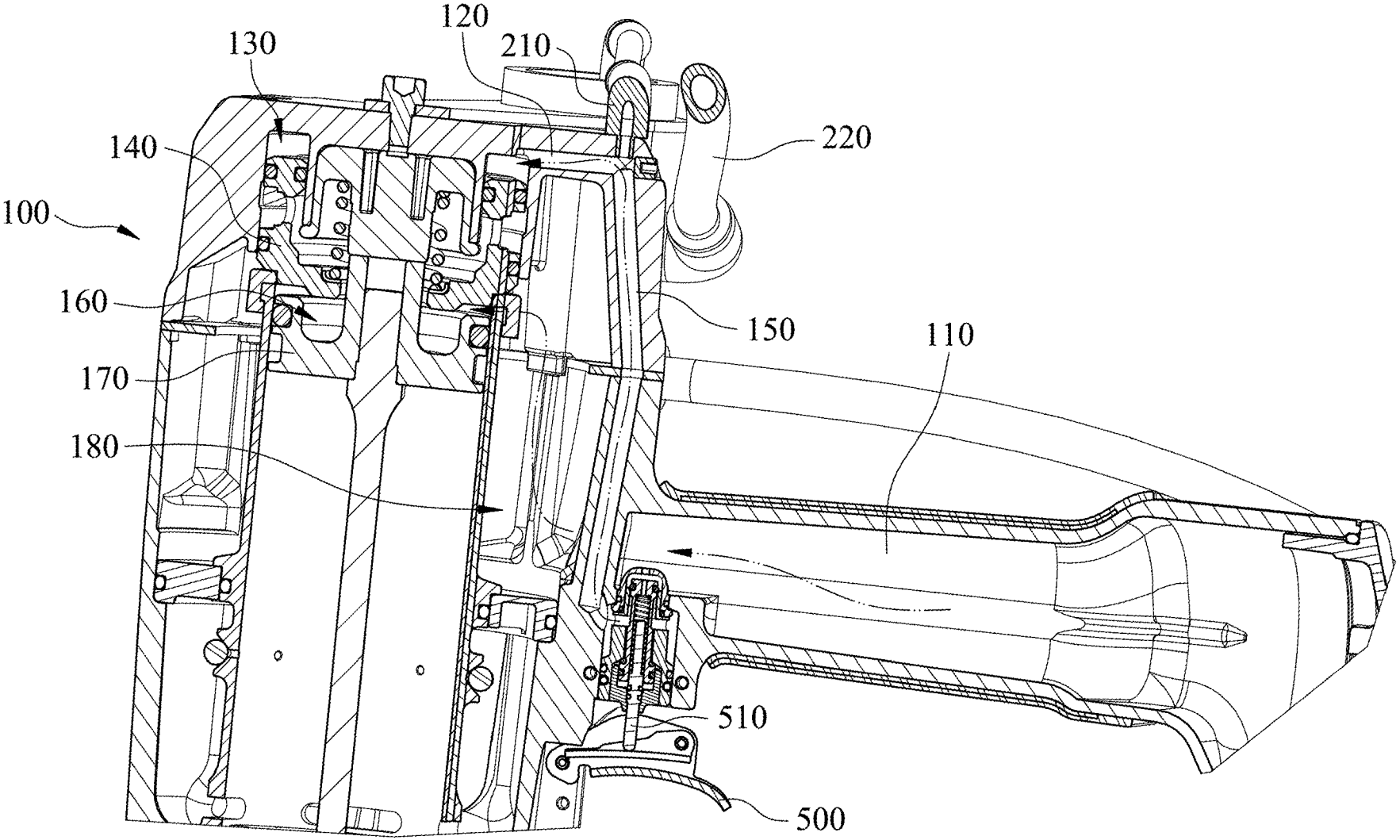
FIG. 3 shows another partial cross-sectional view of the pneumatic pallet nailer according to the embodiment of FIG. 1.

Please refer to FIG. 1, FIG. 2, and FIG. 3. FIG. 1 shows a three dimensional schematic view of a pneumatic pallet nailer 10 according to one embodiment of the present disclosure. FIG. 2 shows one partial cross-sectional view of the pneumatic pallet nailer 10 according to the embodiment of FIG. 1. FIG. 3 shows another partial cross-sectional view of the pneumatic pallet nailer 10 according to the embodiment of FIG. 1. The pneumatic pallet nailer 10 includes a nailer body 100, a pallet clamp controlling member 200, a trigger member 500, a pallet clamp cylinder 300, and a pallet clamp 400.

The trigger member 500 is disposed on the nailer body 100. The pallet clamp controlling member 200 is disposed on the nailer body 100 and includes an internal space S1, a first pipe 210, a second pipe 220, a third pipe 230, and an actuating valve 250. The first pipe 210 is communicated with the internal space S1. The air in the nailer body 100 enters the internal space S1 through the trigger member 500 and the first pipe 210. The second pipe 220 is for communicating the air in the nailer body 100 with the internal space S1. The third pipe 230 is communicated with the internal space S1. The actuating valve 250 is movably accommodated in the internal space S1, and the actuating valve 250 is actuated and positioned at a first position or a second position. The pallet clamp cylinder 300 is communicated with the third pipe 230. The pallet clamp 400 is actuated by the pallet clamp cylinder 300.

When the trigger member 500 is not actuated, the air enters the internal space S1 through the first pipe 210 to generate a first direction force F1 to push the actuating valve 250, and the air enters the internal space S1 through the second pipe 220 to generate a second direction force F2 to push the actuating valve 250; meanwhile, the first direction force F1 is greater than the second direction force F2, and the actuating valve 250 is maintained at the first position to prevent the air from flowing into the third pipe 230 from the second pipe 220. When the trigger member 500 is pressed, the air is blocked and cannot be provided to the first pipe 210, the air in the first pipe 210 is released through the trigger member 500, and thereby the second direction force F2 is greater than the first direction force F1 and the actuating valve 250 is pushed to be positioned at the second position. The air is allowed to flow into the third pipe 230 and the pallet clamp cylinder 300 through the second pipe 220, so that the pallet clamp 400 is actuated to clamp a workpiece M1 (shown in FIG. 6).

Therefore, by the structural configuration of the pallet clamp controlling member 200, the workpiece M1 can be clamped by pressing the trigger member 500, which has the effect of simple operation. The details of the pneumatic pallet nailer 10 will be described hereafter.

The nailer body 100 can include a nailer grip 102 and a nailer head 101. The nailer head 101 is connected to the nailer grip 102. The air in the nailer body 100 is separated in the nailer head 101 to form a top inner seat pressure source and an internal pressure source. The first pipe 210 is communicated with the top inner seat pressure source, and the second pipe 220 is communicated with the internal pressure source. In detail, the nailer grip 102 and the nailer head 101 are connected to form a T-shaped structure. The nailer body 100 further includes a main air channel 110, an inlet-and-exhaust air channel 150, a nailer head inlet channel 180, a top inner seat air chamber 130, a top inner seat 140, a top inner seat air channel 120, a trigger air chamber 160 and a trigger portion 170. The main air channel 110 is located at the nailer grip 102. The inlet-and-exhaust air channel 150 and the nailer head inlet channel 180 are separately located in the nailer head 101 and are not communicated with each other. The inlet-and-exhaust air channel 150 can be selected to be communicated or not communicated with the main air channel 110 according to the operating state of the trigger member 500, and the nailer head inlet channel 180 is maintained at the communicating state with the main air channel 110.

The top inner seat air chamber 130 is located in the nailer head 101 and communicated with the top inner seat air channel 120. The top inner seat 140 is movably located in the top inner seat air chamber 130. The trigger air chamber 160 is adjacent to the top inner seat 140 and controllably communicated with the nailer head inlet channel 180. The trigger portion 170 is movably located in the trigger air chamber 160. When the nailer body 100 is communicated with the main air pressure source, the air enters the main air channel 110, and one part of the air enters the inlet-and-exhaust air channel 150 through the trigger member 500 to form the top seat pressure source. Since the top seat air channel 120 and the first pipe 210 are respectively communicated with the inlet-and-exhaust air channel 150, the air of the top inner seat pressure source can be provided to the top inner seat air channel 120 and the first pipe 210. Moreover, another part of the air enters the nailer head inlet channel 180 to form the internal pressure source, and the second pipe 220 is communicated with the nailer head inlet channel 180.

The pallet clamp controlling member 200 includes a housing 240. The housing 240 is hollow and an internal space S1 is formed therein. The first pipe 210 is connected to an upper end surface (not labeled) of the housing 240. The second pipe 220 is connected to a side surface (not labeled) of the housing 240, and the third pipe 230 is connected to the lower end surface (not labeled) of the housing 240. The actuating valve 250 is located in the housing 240 and can be movable in the internal space S1 to be positioned at the first position or the second position. The actuating valve 250 can have a first pressed surface A1 corresponding to the first pipe 210. The actuating valve 250 can have a second pressed surface A2 corresponding to the second pipe 220. The first pressed surface A1 is parallel to a radial direction R1. An angle is configured between the second pressed surface A2 and the radial direction R1, and a length of the first pressed surface A1 in the radial direction R1 is greater than the length of the second pressed surface A2 in the radial direction R1.

Therefore, when the trigger member 500 is not actuated, as shown in FIG. 2, the air of the top inner seat pressure source can enter the first pipe 210 and apply the first direction force F1 to the actuating valve 250. The air of the internal pressure source enters the second pipe 220 and applies the second direction force F2 to the actuating valve 250. The first direction force F1 and the second direction force F2 are both parallel to the axial direction 11, but the directions thereof are opposite. Because the first pressed surface A1 is parallel to the radial direction R1, the total pressure applied to the first pressed surface A1 by the air along the axial direction 11 is the first direction force F1. Regard to the second pressed surface A2, since the second pressed surface A2 is an inclined surface, the second direction force F2 refers to the component force of the total pressure applied to the second pressed surface A2 by the air along the axial direction 11. Therefore, when the length of the first pressed surface A1 in the radial direction R1 is greater than the length of the second pressed surface A2 in the radial direction R1, the first direction force F1 is greater than the second direction force F2, and the actuating valve 250 is positioned at the first position to prevent the air from flowing into the third pipe 230 from the second pipe 220.

Meanwhile, as shown in FIG. 3, the air of the top seat pressure source enters the top inner seat air chamber 130 to push the top inner seat 140, so that the air of the internal pressure source is unable to enter the trigger air chamber 160, the trigger portion 170 is unable to be actuated, and the nails (not shown) cannot be triggered out.

Figure 4:
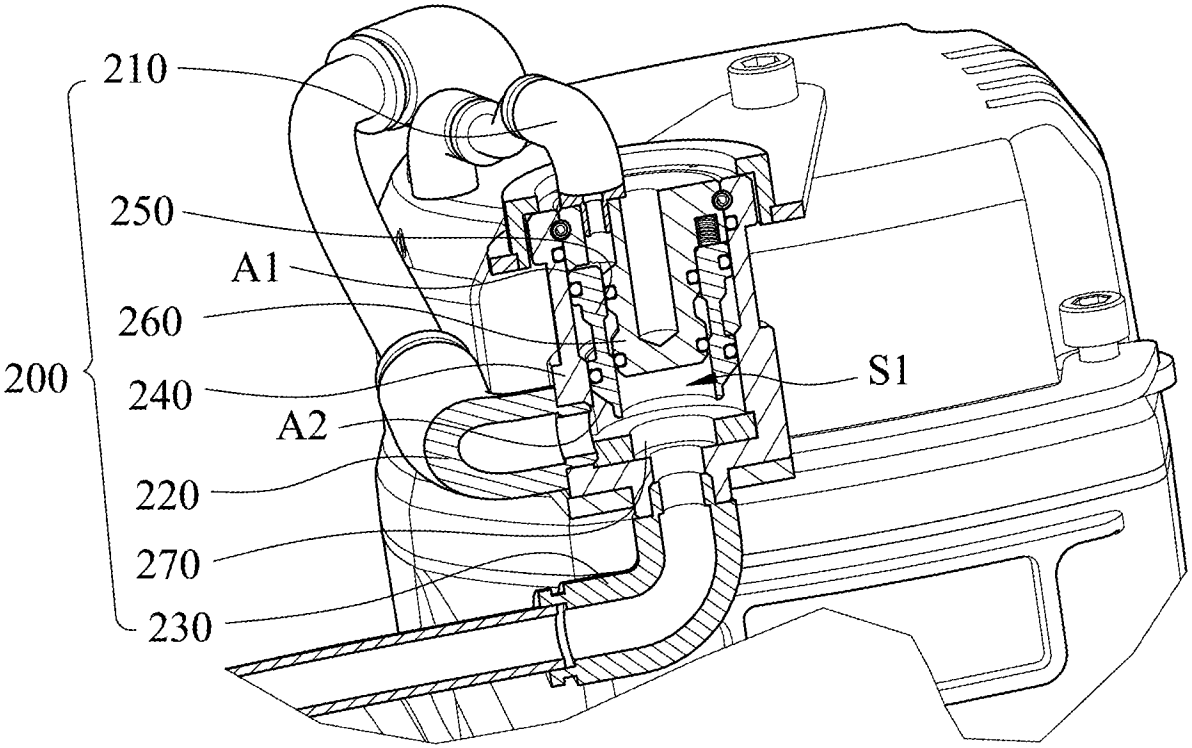
FIG. 4 shows further another partial cross-sectional view of the pneumatic pallet nailer according to the embodiment of FIG. 1.
Figure 5:
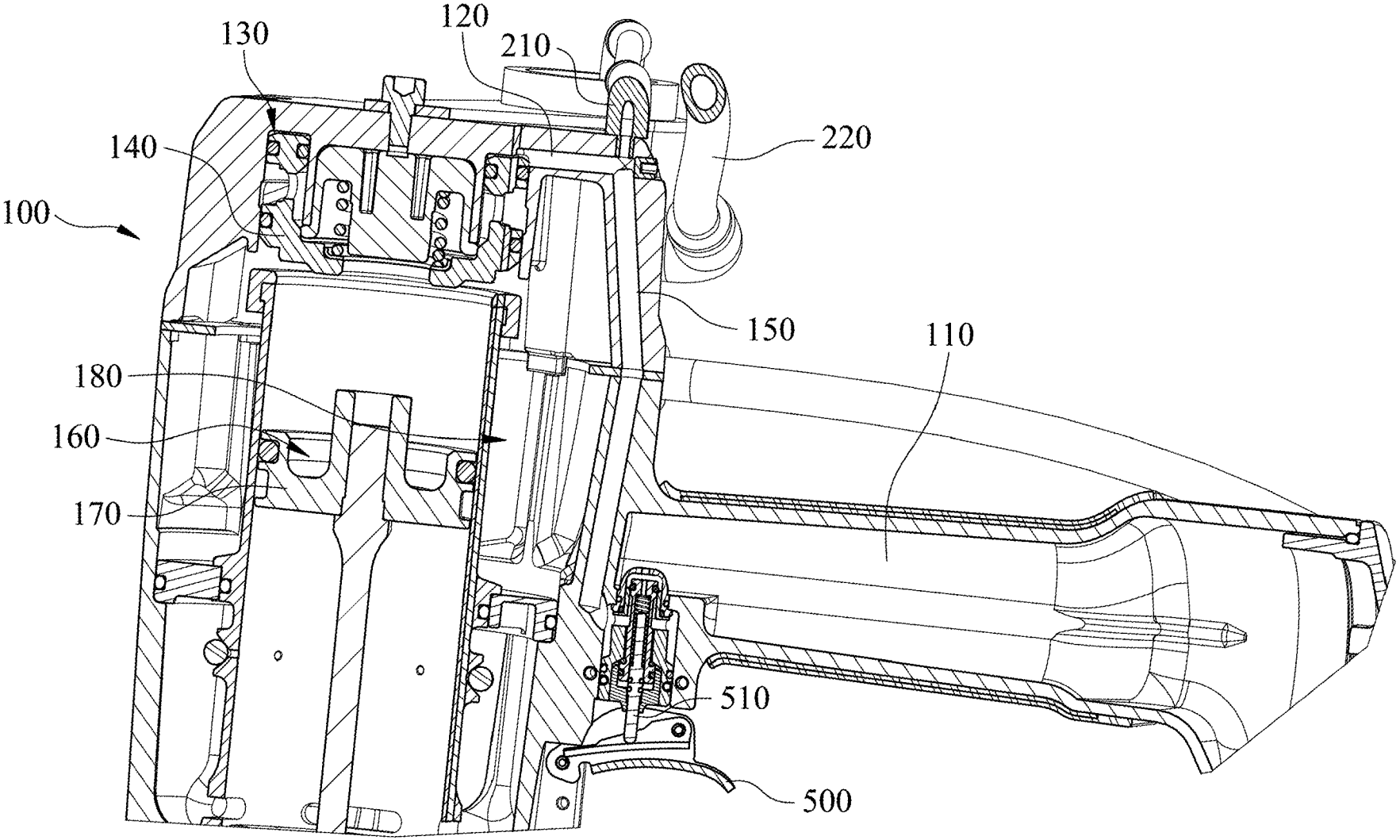
FIG. 5 shows still another partial cross-sectional view of the pneumatic pallet nailer according to the embodiment of FIG. 1.
Figure 6:
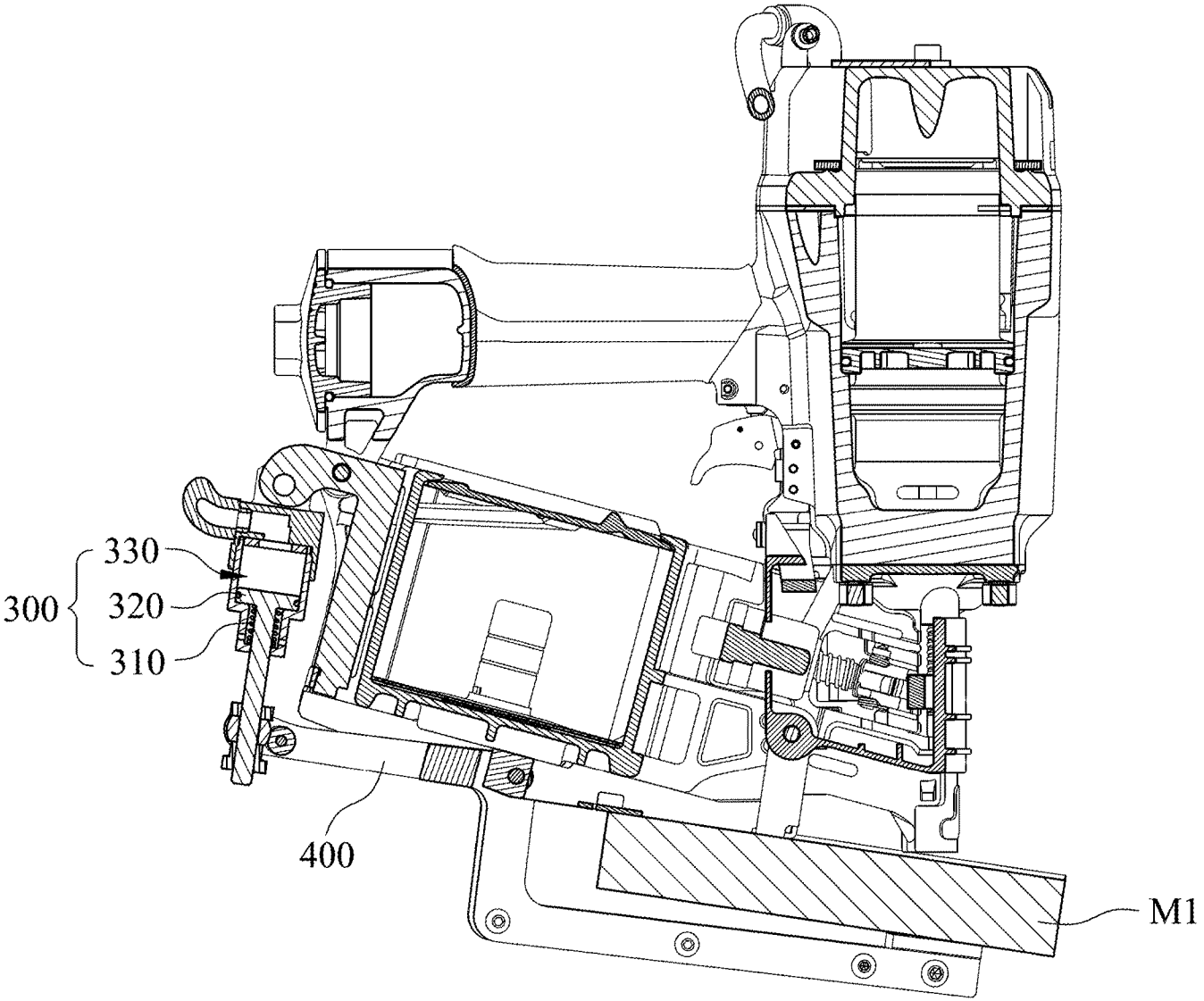
FIG. 6 shows yet another partial cross-sectional view of the pneumatic pallet nailer according to the embodiment of FIG. 1.

Please refer to FIG. 4, FIG. 5, and FIG. 6. FIG. 4 shows further another partial cross-sectional view of the pneumatic pallet nailer 10 of FIG. 1. FIG. 5 shows still another partial cross-sectional view of the pneumatic pallet nailer 10 of FIG. 1. FIG. 6 shows yet another partial cross-sectional view of the pneumatic pallet nailer 10 of FIG. 1. When the user presses the trigger member 500, the valve stem 510 of the trigger member 500 is actuated to prohibit the air in the main air channel 110 from flowing into the inlet-and-exhaust air channel 150, and the air in the inlet-and-exhaust air channel 150, i.e., the top inner seat pressure source, can flow out and be released through the trigger member 500. Meanwhile, as shown in FIG. 4, the air in the first pipe 210 is released. The first direction force F1 is decreased to less than the second direction force F2, and the actuating valve 250 is pushed to the second position along the axial direction 11 by the second direction force F2, so that the second pipe 220 and the third pipe 230 are communicated with each other.

As shown in FIG. 6, the pallet clamp cylinder 300 drives the pallet clamp 400 to clamp the workpiece M1. In detail, the pallet clamp cylinder 300 includes a pallet clamp air chamber 330 and a pallet clamp piston 320. The pallet clamp piston 320 is movable in the pallet clamp air chamber 330 and is connected to the pallet clamp 400. The air enters the pallet clamp air chamber 330 to push the pallet clamp piston 320, and the pallet clamp 400 is linked with the pallet clamp piston 320 to clamp the workpiece M1. Therefore, since the actuating valve 250 is moved, the air of the internal pressure source can enter the pallet clamp air chamber 330 through the second pipe 220 and the third pipe 230, so that the pallet clamp piston 320 can be pushed to actuate so as to achieve the effect of driving the pallet clamp 400. Moreover, in the embodiment of FIG. 6, the pallet clamp cylinder 300 can further include a restoring spring 310 which is abutted against the pallet clamp piston 320 to provide a restoring force.

Since the air in the inlet-and-exhaust air channel 150, i.e., the top inner seat pressure source, can flow out and be released through the trigger member 500, the air in the top inner seat air chamber 130 has been released, as shown in FIG. 6, and the air of the internal pressure source pushes against the top inner seat 140 to be moved and enters the trigger air chamber 160 to push the trigger portion 170 for triggering the nail. It should be noted that, as long as the first pipe 210 starts to release the air to cause the first direction force F1 being smaller than the second direction force F2, the actuating valve 250 will immediately move to the second position without waiting for the air to be completely released. Therefore, there can have a time precedence between clamping of the workpiece M1 and the nail triggering of the trigger portion 170, so that the clamping of the workpiece M1 and the nail triggering can be completed by pressing the trigger member 500, and the operation thereof is simplified.

Figure 7:
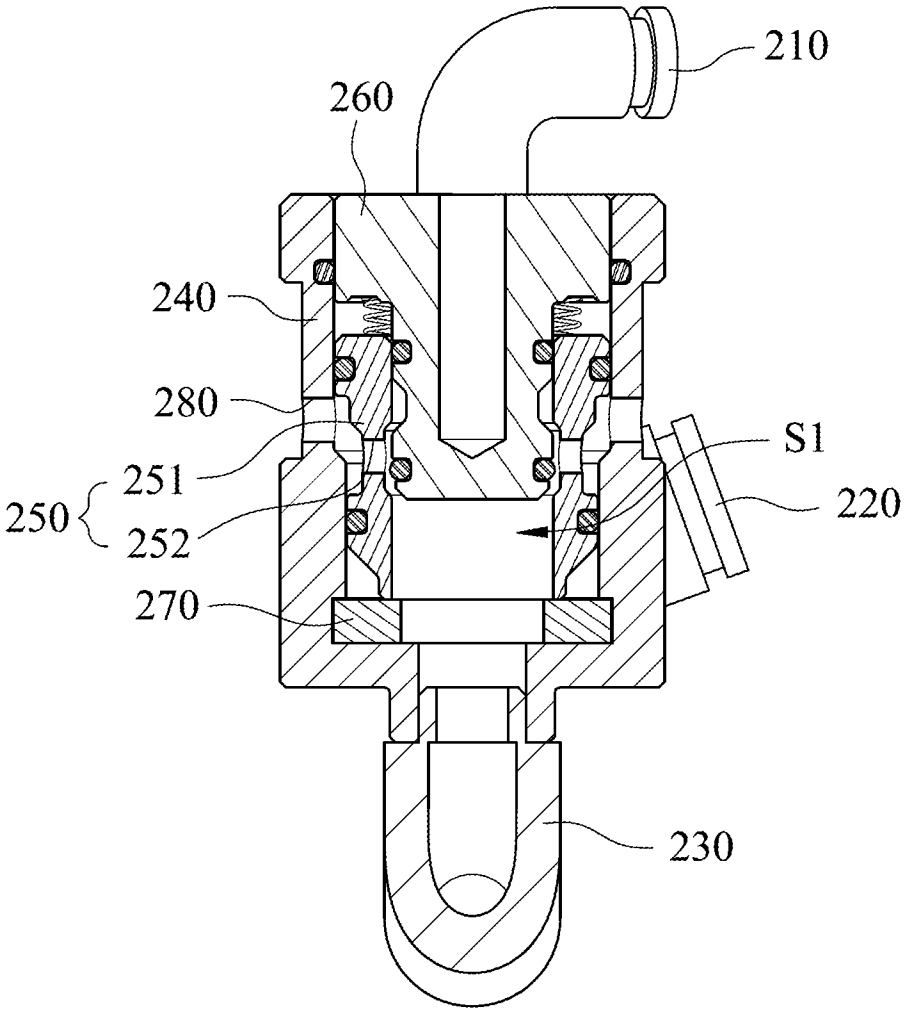
FIG. 7 shows a partial cross-sectional view of the pallet clamp controlling member of the pneumatic pallet nailer according to the embodiment of FIG. 1.

Please refer to FIG. 7 and FIG. 4. FIG. 7 shows a partial cross-sectional view of the pallet clamp controlling member 200 of the pneumatic pallet nailer 10 of FIG. 1. After nail triggering, the pallet clamp 400 should be restored. Therefore, the actuating valve 250 can include a hollow annular member 251 and at least one exhausting hole 252. The hollow annular member 251 is accommodated in the internal space S1, and the at least one exhausting hole 252 is located in the hollow annular member 251 and communicated with the inner portion of the hollow annular member 251. The pallet clamp controlling member 200 can further include at least one opening 280 and a plunger 260. The at least one opening 280 is located on the housing 240 and communicated with the internal space S1. The plunger 260 is located in the housing 240 and is configured for the actuating valve 250 to sleeve thereon. When the actuating valve 250 is positioned at the first position, the air in the third pipe 230 flows out of the housing 240 through a gap between the plunger 260 and the actuating valve 250, the at least one exhausting hole 252 and the aforementioned at least one opening 280. When the actuating valve 250 is positioned at the second position, the gap is closed, and the second pipe 220 is communicated with the third pipe 230.

In other words, as shown in FIG. 4, when the actuating valve 250 is at the second position, the inner diameter of the plunger 260 matches the inner diameter of the actuating valve 250, so that no gap is contained therebetween, i.e., the gap is closed. The air of the second pipe 220 can only flow to the third pipe 230 to cause the pallet clamp cylinder 300 to drive the pallet clamp 400. On the contrary, as shown in FIG. 7, when the trigger member 500 is released, the air in the main air channel 110 can flow into the inlet-and-exhaust air channel 150 again to enter the first pipe 210, the actuating valve 250 returns to the first position, and a gap is contained between the plunger 260 and the actuating valve 250. The second pipe 220 and the third pipe 230 are blocked by the actuating valve 250 and not communicated with each other. Therefore, the air in the third pipe 230 can only flow to the gap, and then flows out through the opening 280 and the exhausting hole 252, so that the air of the pallet clamp cylinder 300 is released, and the pallet clamp piston 320 drives the pallet clamp 400 to be restored. It should be particularly noted that, in the embodiment shown in FIG. 7, the number of the opening 280 and the exhausting hole 252 are both two; however, the present disclosure is not limited thereto.

The pallet clamp controlling member 200 of FIG. 7 further includes a cushion 270 located in the internal space S1. The cushion 270 is disposed on the lower end surface of the housing 240 and is selectively abutted by the actuating valve 250. Therefore, damage of the actuating valve 250 can be prevented.

Although the present disclosure has been described in considerable detail with reference to certain embodiments thereof, other embodiments are possible. Therefore, the spirit and scope of the appended claims should not be limited to the description of the embodiments contained herein. It will be apparent to those skilled in the art that various modifications and variations can be made to the structure of the present disclosure without departing from the scope or spirit of the disclosure. In view of the foregoing, it is intended that the present disclosure cover modifications and variations of this disclosure provided they fall within the scope of the following claims.

What is claimed is:

1. A pneumatic pallet nailer, comprising:

a nailer body;

a trigger member disposed on the nailer body;

a pallet clamp controlling member disposed on the nailer body and comprising:

an internal space;

a first pipe communicated with the internal space, wherein an air in the nailer body enters the internal space through the trigger member and the first pipe;

a second pipe for communicating the air in the nailer body with the internal space;

a third pipe communicated with the internal space; and an actuating valve movably accommodated in the internal space, the actuating valve actuated and positioned at a first position or a second position;

a pallet clamp cylinder communicated with the third pipe; and a pallet clamp actuated by the pallet clamp cylinder;

wherein when the trigger member is not actuated, the air enters the internal space through the first pipe to generate a first direction force for pushing the actuating valve, the air enters the internal space through the second pipe to generate a second direction force for pushing the actuating valve, the first direction force is greater than the second direction force, and the actuating valve is maintained at the first position so as to prevent the air from flowing into the third pipe from the second pipe; when the trigger member is pressed, the air in the first pipe is released through the trigger member, so that the second direction force is greater than the first direction force, the actuating valve is pushed to be positioned at the second position, and the air is allowed to flow into the third pipe and then into the pallet clamp cylinder through the second pipe, so that the pallet clamp is actuated to clamp a workpiece.

2. The pneumatic pallet nailer of claim 1, wherein the nailer body comprises:

a nailer grip; and a nailer head connected to the nailer grip;

wherein the air in the nailer body is separated in the nailer head to form a top inner seat pressure source and an internal pressure source, the first pipe is communicated with the top inner seat pressure source, and the second pipe is communicated with the internal pressure source.

3. The pneumatic pallet nailer of claim 2, wherein, the actuating valve comprises:

a hollow annular member accommodated in the internal space; and at least one exhausting hole located at the hollow annular member and communicated to an inner portion of the hollow annular member; and the pallet clamp controlling member further comprises:

a housing;

at least one opening located on the housing and communicated with the internal space; and a plunger located in the housing and configured for the actuating valve to sleeve thereon;

wherein, when the actuating valve is positioned at the first position, the air in the third pipe flows out of the housing through a gap between the plunger and the actuating valve, the at least one exhausting hole, and the at least one opening; when the actuating valve is positioned at the second position, the gap is closed, and the second pipe is communicated with the third pipe.

4. The pneumatic pallet nailer of claim 3, wherein the pallet clamp controlling member further comprises:

a cushion located in the internal space, the cushion disposed on a lower end surface of the housing and selectively abutted by the actuating valve.

5. The pneumatic pallet nailer of claim 1, wherein the pallet clamp cylinder comprises:

a pallet clamp air chamber; and a pallet clamp piston movably disposed in the pallet clamp air chamber and connected to the pallet clamp;

wherein the air enters the pallet clamp air chamber to push the pallet clamp piston, and the pallet clamp is linked with the pallet clamp piston so as to clamp the workpiece.

6. The pneumatic pallet nailer of claim 5, wherein the pallet clamp cylinder further comprises:

a restoring spring abutted against the pneumatic clamp piston for providing a restoring force.

* * * * *